US006650051B1

(12) United States Patent
Park et al.

(10) Patent No.: US 6,650,051 B1
(45) Date of Patent: Nov. 18, 2003

(54) PLASMA DISPLAY PANEL

(75) Inventors: Chang-bae Park, Cheonan (KR); Young-cheul Kang, Cheonan (KR); Cheol-hee Moon, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/512,834

(22) Filed: Feb. 25, 2000

(30) Foreign Application Priority Data

Feb. 25, 1999 (KR) ..... 1999-6287

(51) Int. Cl.[7] ..... H01J 17/49
(52) U.S. Cl. ..... 313/582; 313/584; 313/586
(58) Field of Search ..... 313/582, 584, 313/586, 466, 471, 489

(56) References Cited

U.S. PATENT DOCUMENTS 5,952,782 A * 9/1999 Nanto et al. ..... 313/584
6,034,474 A * 3/2000 Ueoka et al. ..... 313/584
6,084,349 A * 7/2000 Ueoka et al. ..... 313/584
6,140,758 A * 10/2000 Matsuda et al. ..... 313/466
6,333,597 B1 * 12/2001 Mitomo ..... 313/489

FOREIGN PATENT DOCUMENTS

JP 9-129142 5/1997

* cited by examiner

*Primary Examiner*—Sandra O'Shea
*Assistant Examiner*—Bao Truong
(74) *Attorney, Agent, or Firm*—Lowe Hauptman & Gilman & Berner LLP

(57) ABSTRACT

In a plasma display panel, a scanning electrode and a common electrode are alternately formed in strips and parallel to one another on a lower surface of a front substrate. A bus electrode is formed on lower surfaces of the respective scanning and common electrodes to have a narrower width than that of each of the scanning and common electrodes. A black matrix layer is formed of the same insulative material to be parallel to the electrodes at a boundary area between neighboring discharge cells, in which each cell is constituted by a discharge space including a pair of the scanning electrode and the common electrode, and between the scanning and common electrodes and the bus electrode, on a lower surface of the front substrate.

20 Claims, 7 Drawing Sheets

PLASMA DISPLAY PANEL

BACKGROUND OF THE INVENTION

1. Field of the Invention

The present invention relates to a plasma display panel having an improved structure of a black matrix layer formed on a front substrate.

2. Description of the Related Art

In a plasma display panel, discharge gas filled between a pair of substrates opposing one another is discharged and ultraviolet rays generated during the discharge become excited to form an image.

The plasma display panel is classified into a DC type and an AC type depending on the type of discharge and an opposing discharge type and a surface discharge type depending on the arrangement of electrodes.

FIG. 1 is a view showing an example of a conventional plasma display panel. Referring to the drawing, a plurality of common electrodes 12*a* and scanning electrodes 12*b* are alternately formed in strips on the lower surface of a front substrate 11*a*. The electrodes 12*a* and 12*b* can be respectively provided with bus electrodes 13*a* and 13*b*, each having a narrower width than that of the electrodes 12*a* and 12*b* to reduce line resistance. The common and scanning electrodes 12*a* and 12*b* and the bus electrodes 13*a* and 13*b* are embedded in a dielectric layer 14 coated on the lower surface of the front substrate 11*a*. A protective film 15 such as a magnesium oxide (MgO) film can be formed on the lower surface of the dielectric layer 14.

A maintenance discharge is generated between the common and scanning electrodes 12*a* and 12*b*. A pair of the common and scanning electrodes 12*a* and 12*b* constitute one discharge cell. An insulation layer 1 is formed between adjacent discharge cells. Also, a conductive layer 2 is respectively formed between the common electrode 12*a* and the bus electrode 13*a*, and the scanning electrode 12*b* and the bus electrode 13*b*. The insulation layer 1 and the conductive layer 2 are generally black.

An address electrode 16 is formed in strips to cross both electrodes 12*a* and 12*b* on the upper surface of a rear substrate 11*b* which is installed to be opposite the front substrate 11*a*. The address electrode 16 is embedded in a dielectric layer 17 coated on the front substrate 11*a*. A plurality of partitions 18 defining a discharge space are formed on the dielectric layer 17 spaced apart from one another. A fluorescent layer 19 is coated on a surface inside the discharge space.

In the conventional plasma display panel having the above structure, when voltage is applied to the scanning electrode 12*b* and the address electrode 16, a preliminary discharge is generated and wall charges are filled in the discharge space. When a voltage is applied between the common electrode 12*a* and the scanning electrode 12*b*, under the above circumstances, a maintenance discharge is generated and plasma is generated so that ultraviolet rays are emitted to excite the fluorescent layer 19 and an image is finally formed.

Here, the black insulation layer 1 and the conductive layer 2 reduce a color blurring phenomenon due to weak light emission in a non-discharging area, lower reflectance of the external light of the front substrate 11*a*, and block light emission due to a so-called background discharge so that contrast is improved.

The insulation layer 1 and the conductive layer 2 are formed of different materials by a print method using a screen where a pattern is formed. That is, the insulation layer 1 is formed of an insulative material which is a mixture of glass powder, lead oxide (PbO), aluminum oxide ($Al_2O_3$), and a black pigment, while the conductive layer 2 is formed of a conductive material which is a mixture of silver powder and an oxide. Consequently, each unit process of forming the insulation layer 1 and conductive layer 2, particularly a photo step and a curing step, becomes relatively complicated so that the working efficiency is lowered.

SUMMARY OF THE INVENTION

To solve the above problems, it is an objective of the present invention to provide a plasma display panel having a simplified manufacturing process by integrally forming a black matrix layer with the same material at the boundary area between neighboring discharge cells and between the respective common and scanning electrodes and the bus electrode.

Accordingly, to achieve the above objective, there is provided a plasma display panel comprising: a front substrate; a scanning electrode and a common electrode which are alternately formed in strips and parallel to one another on a lower surface of the front substrate; a bus electrode formed on lower surfaces of the respective scanning and common electrodes to have a narrower width than that of each of the scanning and common electrodes; and a black matrix layer formed of the same insulative material to be parallel to the electrodes at a boundary area between neighboring discharge cells, each cell being constituted by a discharge space including a pair of the scanning electrode and the common electrode, and between the scanning and common electrodes and the bus electrode, on a lower surface of the front substrate.

It is preferred in the present invention that the black matrix layer formed between the scanning and common electrodes and the bus electrode is thinner than the black matrix layer formed at a boundary area of neighboring discharge cells.

Also, it is preferred in the present invention that the black matrix layer is integrally formed at a boundary area between neighboring discharge cells and between the scanning and common electrodes and the bus electrode.

Further, it is preferred in the present invention that the black matrix layer is formed of an insulation material in which glass powder is mixed with an oxide and a black pigment.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
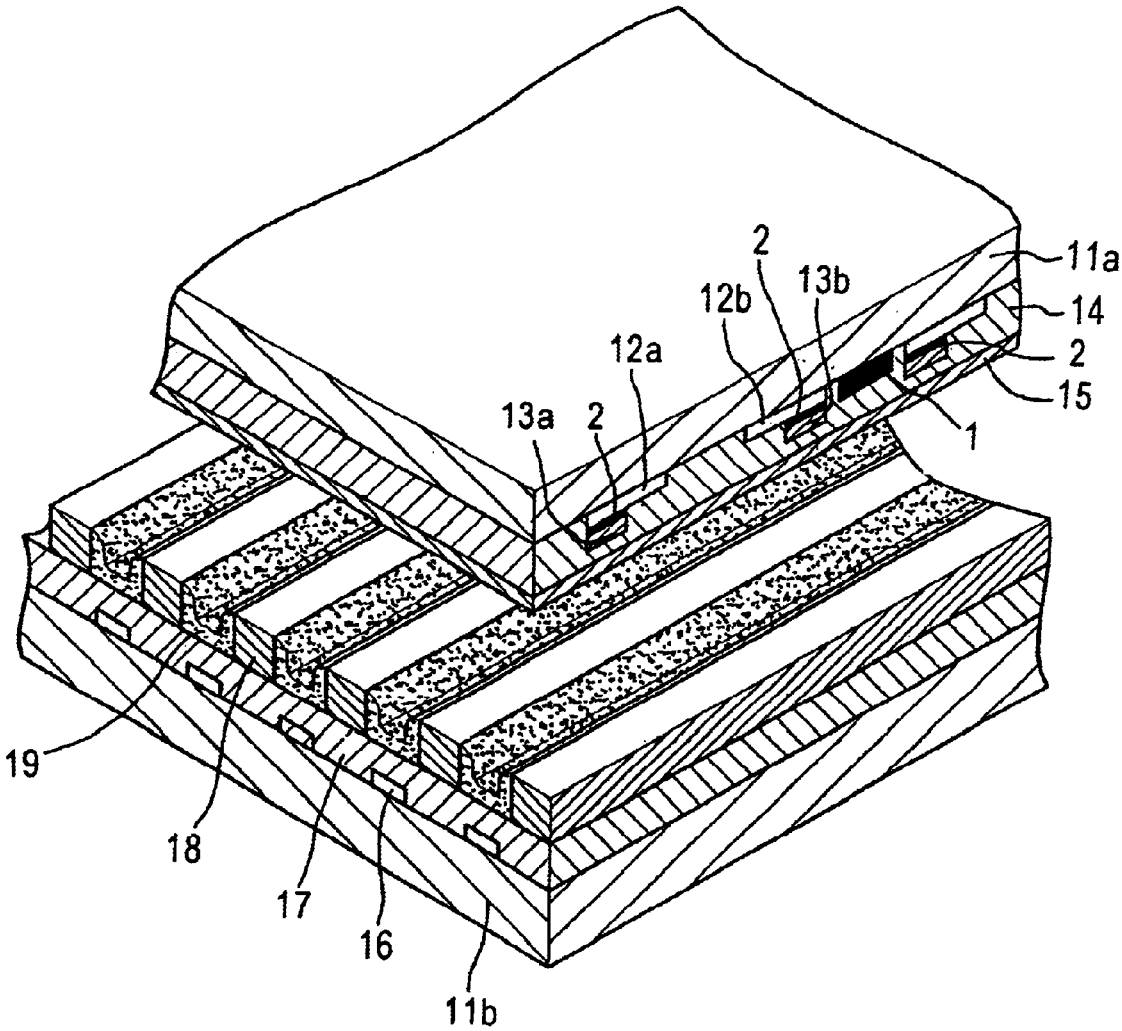
FIG. 1 (PRIOR ART)
FIG. 1 is an exploded perspective view showing a conventional plasma display panel.
Figure 2:
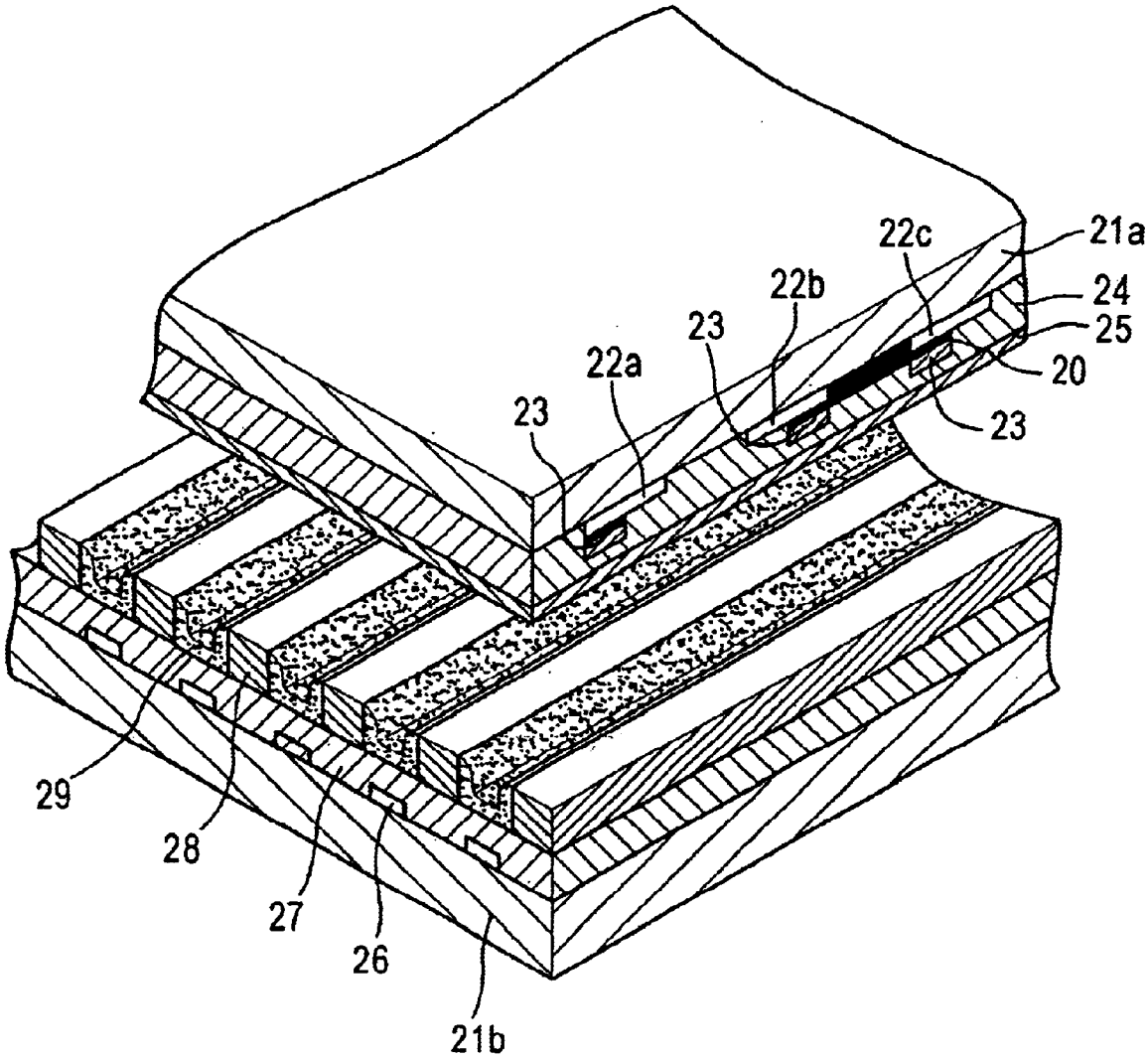
FIG. 2 is an exploded perspective view showing a plasma display panel according to a preferred embodiment of the present invention.

FIG. 2 shows a plasma display panel according to the first preferred embodiment of the present invention. Referring to the drawing, a plurality of common electrodes 22*a* and scanning electrodes 22*b* are alternately formed in strips on the lower surface of the front substrate 21*a*. A conductive bus electrode 23 having a narrower width than that of the common and scanning electrodes 22*a* and 22*b* is formed on the lower surfaces of the common and scanning electrodes 22*a* and 22*b* to reduce line resistance. The electrodes 22*a* and 22*b* are embedded in a dielectric layer 24 coated on the lower surface of the front substrate 21*a*. Also, a protective layer 25, formed of magnesium oxide (MgO) for example, can be formed on the lower surface of the dielectric layer 24.

An address electrode 26 is formed in strips to cross the common and scanning electrodes 22*a* and 22*b* of the front substrate 21 a on a rear substrate 21*b* installed facing the front substrate 21*a*. The address electrode 26 is embedded in a dielectric layer 27. A plurality of partitions 28 defining a discharge space are formed spaced apart from one another on the upper surface of the dielectric layer 27. A fluorescent layer 29 is coated on a surface inside the discharge space.

A maintenance discharge is generated between the common electrode 22*a* and the scanning electrode 22*b*. The discharge space including a pair of the common electrode 22*a* and the scanning electrode 22*b* constitute one discharge cell.

According to the characteristic feature of the present invention, a black matrix layer 20 is formed at the boundary area between the respective discharge cells, i.e., between the scanning electrode 22*b* and a common electrode 22*c* of the adjacent discharge cell, and between the respective scanning and common electrodes 22*b* and 22*c* and the bus electrode 23. The black matrix layer 20 is formed of an insulation material in which glass powder is mixed with an oxide and a black pigment.

A method of manufacturing a plasma display panel having the above structure is as follows. The common electrode 22*a* and the scanning electrode 22*b* are formed by depositing an indium tin oxide (ITO) film on the transparent front substrate 21*a* by a sputtering method. A photosensitive black matrix material is coated in strips between the boundary area between neighboring discharge cells, i.e., the scanning electrode 22*b* and the common electrode 22*c* of the adjacent discharge cell. Here, the black matrix material is coated on parts of the upper surfaces of the common electrode 22*a* and the scanning electrode 22*b* on which the bus electrode 23 is to be formed. The thickness of the black matrix material coated on the upper surface of the common electrode 22*a* and the scanning electrode 22*b* is thinner than that of the black matrix coated on the boundary area between neighboring discharge cells. Preferably, the width of the black matrix coated on the lower surfaces of the common and scanning electrodes 22*a* and 22*b* is the same as that of the bus electrode 23.

Next, the black matrix material is exposed to light and developed to obtain a desired pattern. After a black matrix pattern is formed, the patterned black matrix material is heated to a temperature range of 550° C.–620° C. to complete the black matrix layer 20. Here, since the black matrix layer 20 coated on the lower surfaces of the common and scanning electrodes 22*a* and 22*b* is thin, conductive particles included in the common and scanning electrodes 22*a* and 22*b* are thermally diffused into the black matrix layer 20 during the heat processing so that the common and scanning electrodes 22*a* and 22*b* and the bus electrode 23 become conductive with each other.

Then, the bus electrode 23 is formed to reduce line resistance on the lower surface of the black matrix layer 20 coated on the lower surfaces of the common and scanning electrodes 22*a* and 22*b*, by printing a conductive paste formed of silver or silver alloy, or in a photolithography method.

Since the subsequent manufacturing processes are the same as those in a method for manufacturing an ordinary plasma display panel, a description thereof will be omitted.

FIGS. 3 through 10 show various preferred embodiments according to the present invention. Here, the same reference numerals indicate the same elements throughout the drawings.

Figure 3:
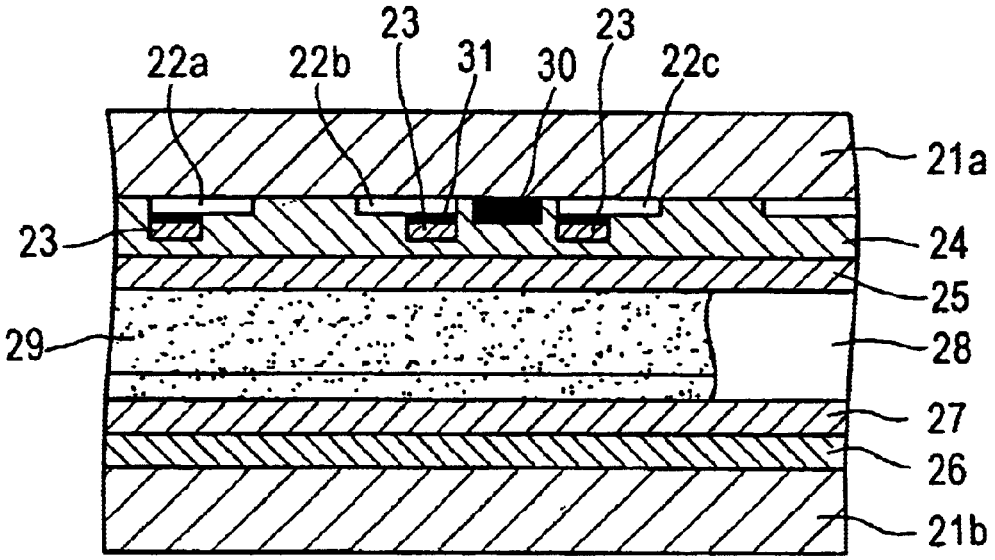
FIGS. 3 and 4 are sectional views respectively showing the second and third preferred embodiments of the plasma display panel according to the present invention.

In FIG. 3, a plasma display panel according to the second preferred embodiment of the present invention is shown. Referring to the drawings, a first black matrix layer 30 is formed in strips between the scanning electrode 22*b* and the common electrode 22*c* of the adjacent discharge cell. A second black matrix layer 31 is formed in strips between the scanning electrode 22*b* and the bus electrode 23 and the common electrode 22*c* and the bus electrode 23, respectively. The first and second black matrix layers 30 and 31 are separated from each other.

The width of the second black matrix layer 31 is preferably the same as that of the bus electrode 23. The first and second black matrix layers 30 and 31 are formed of the same insulation material as in the above-described embodiment. The second black matrix layer 31 is formed to be thin so that the common and scanning electrodes 22*a* and 22*b* and the bus electrode 23 are conductive with each other.

Figure 4:
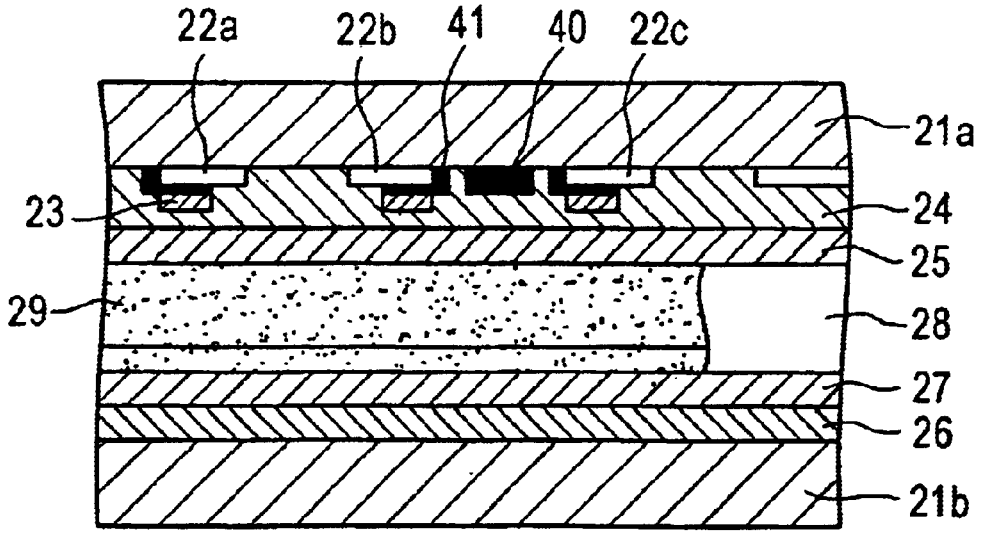

FIG. 4 shows the third preferred embodiment of the present invention. Referring to the drawing, a first black matrix layer 40 is formed in strips at the boundary area between neighboring discharge cells. A second black matrix layer 41 is formed between the scanning and common electrodes 22*b* and 22*c* and the bus electrode 23, and at the side surfaces of the scanning and common electrodes 22*b* and 22*c*.

Figure 5:
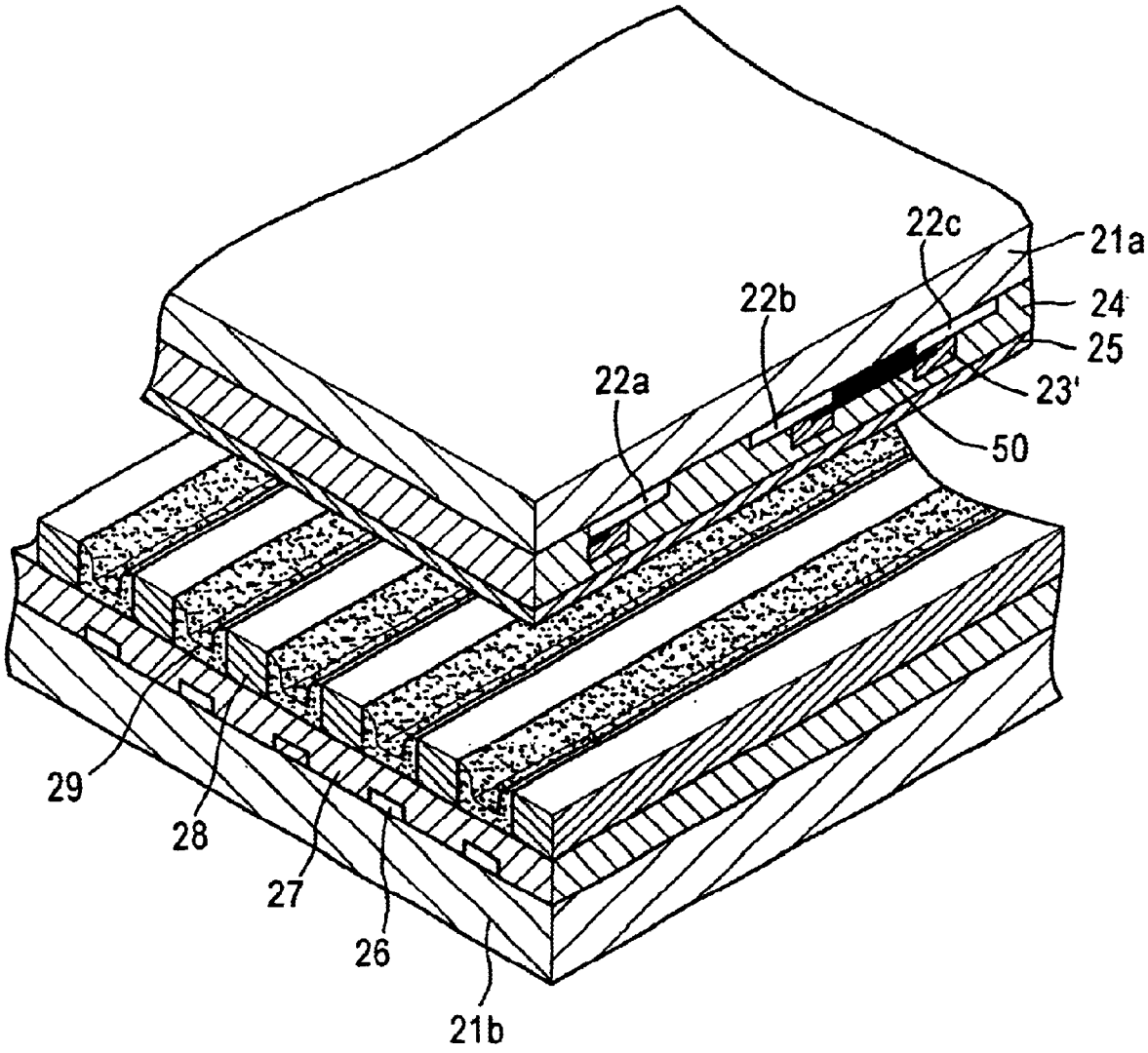
FIG. 5 is an exploded perspective view showing a plasma display panel according to the fourth preferred embodiment of the present invention.

FIG. 5 shows a plasma display panel according to the fourth preferred embodiment of the present invention. As shown in the drawing, an insulative black matrix layer 50 is formed between the scanning and common electrodes 22*b* and 22*c* and the bus electrode 23 and between the scanning electrode 22*b* of one discharge cell and the common electrode 22*c* of the adjacent discharge cell. According to the present preferred embodiment, the width of the black matrix layer 50 formed between the scanning and common electrodes 22*b* and 22*c* and the bus electrode 23 is narrower than that of the bus electrode 23. Hence, the scanning and common electrodes 22*b* and 22*c* and the bus electrode 23 can be electrically conductive.

Figure 6:
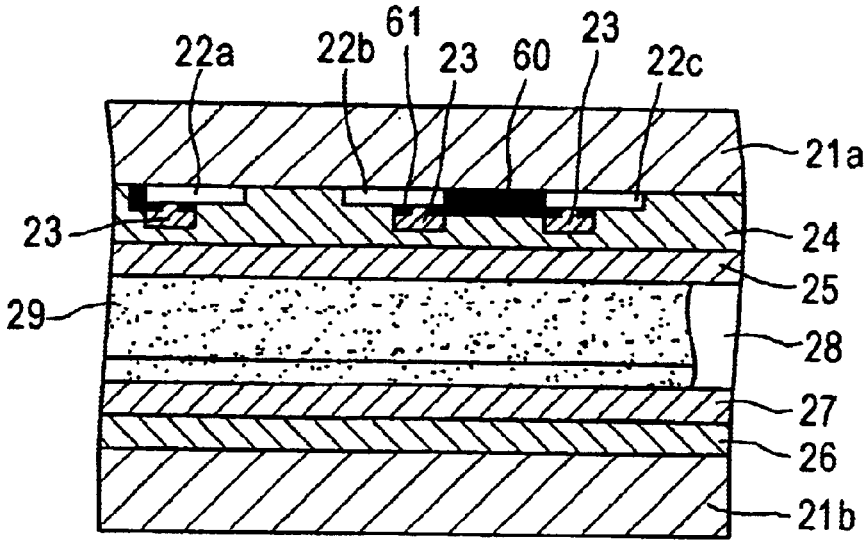
FIG. 6 is a sectional view showing a plasma display panel according to the fifth preferred embodiment of the present invention.

As shown in FIG. 6, according to the fifth preferred embodiment of the present invention, a black matrix layer 60 is formed between the scanning and common electrodes 22*b* and 22*c* and the bus electrode 23, and at the boundary area between neighboring discharge cells. Here, since the black matrix layer 60 is not formed at at least a portion between the scanning and common electrodes 22*b* and 22*c* and the bus electrode 23, electrical conductivity between the electrodes can be obtained. That is, an isolated black matrix layer 61 which is separated from the black matrix layer 60 and has a narrower width than that of the bus electrode 23 is formed between the scanning and common electrodes 22*b* and 22*c* and the bus electrode 23.

Figure 7:
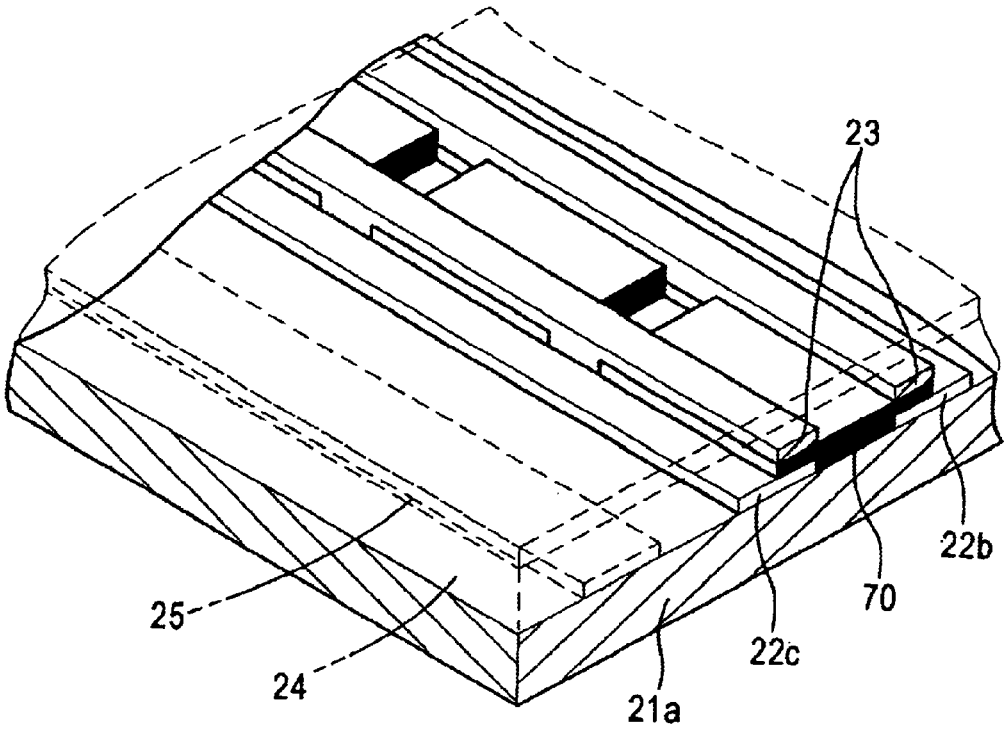
FIGS. 7 and 8 are perspective views respectively showing parts of plasma display panels according to the sixth and seventh preferred embodiments of the present invention.

FIG. 7 is the bottom view of a front substrate of a plasma display panel according to the sixth preferred embodiment of the present invention. Referring to the drawing, a black matrix layer 70 is formed between the scanning and common electrodes 22*b* and 22*c* and the bus electrode 23 and between the scanning electrode 22*b* of one discharge cell and the common electrode 22*c* of the adjacent discharge cell. According to the present preferred embodiment, the black matrix layer 70 is formed discontinuously in a direction parallel to the scanning and common electrodes 22*b* and 22*c*. Thus, electrical conductivity between the scanning and common electrodes 22*b* and 22*c* and the bus electrode 23 can be obtained at an area where the black matrix layer 70 is not formed.

Figure 8:
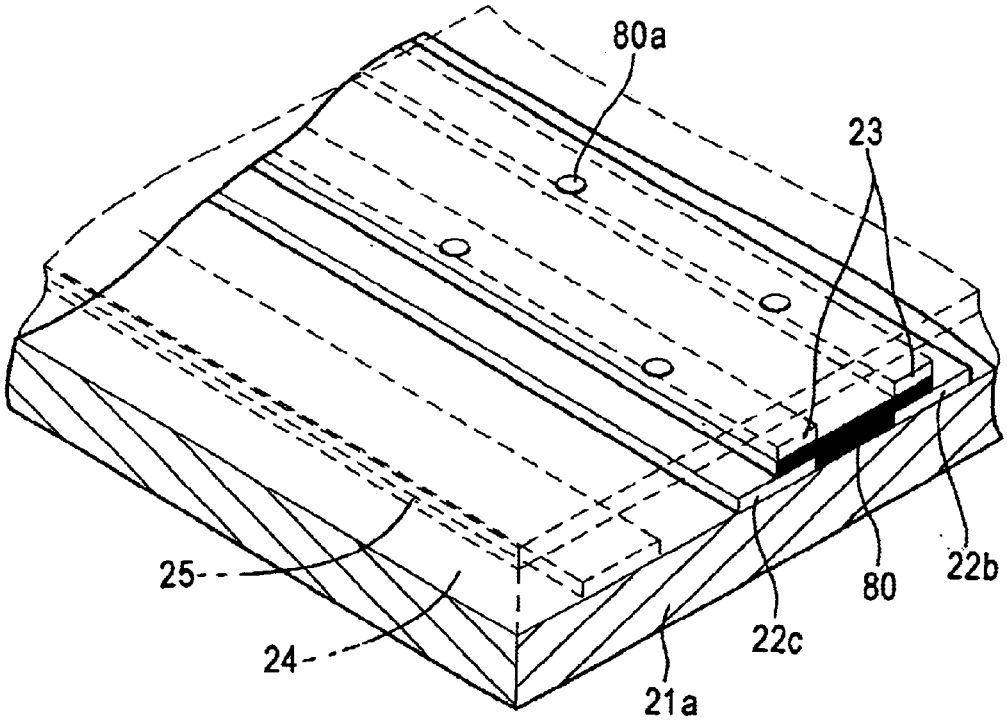

According to the seventh preferred embodiment of the present invention which is shown in FIG. 8, a black matrix layer 80 is formed, continuously and parallel to the electrodes 22*b* and 22*c*, between the scanning and common electrodes 22*b* and 22*c* and the bus electrode 23 and between the scanning electrode 22*b* of one discharge cell and the common electrode 22*c* of the adjacent discharge cell. A plurality of holes 80a are formed in the black matrix layer 80 so that the scanning and common electrodes 22*b* and 22*c* and the bus electrode 23 are electrically connected to one another.

Figure 9:
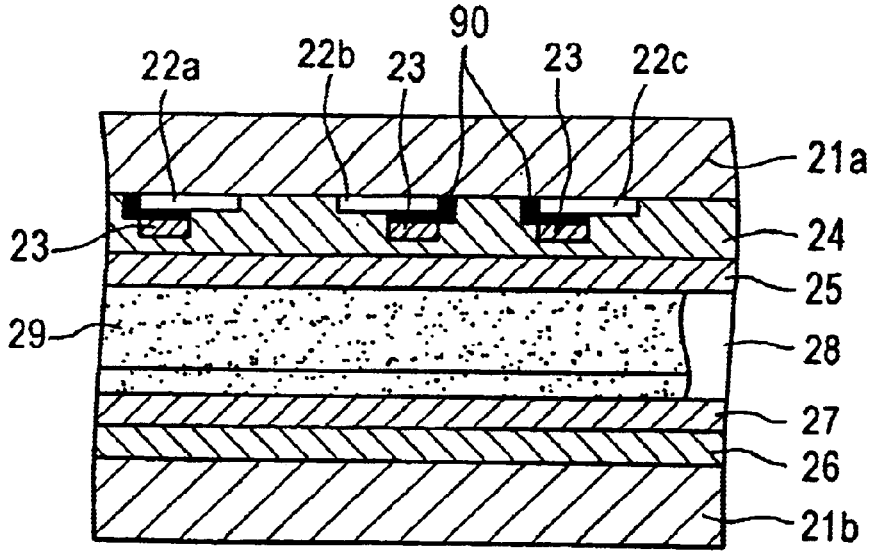
FIGS. 9 and 10 are sectional views showing a plasma display panel according to the eighth and ninth preferred embodiments of the present invention.

FIG. 9 shows a plasma display panel according to the eighth preferred embodiment of the present invention. As shown in the drawing, a black matrix layer 90 is formed between the scanning and common electrodes 22*b* and 22*c* and the bus electrode 23. The black matrix layer 90 is extensively formed to coat either side surface of the scanning electrode 22*b* of one discharge cell and the common electrode 22*c* of the adjacent discharge cell, facing each other.

Figure 10:
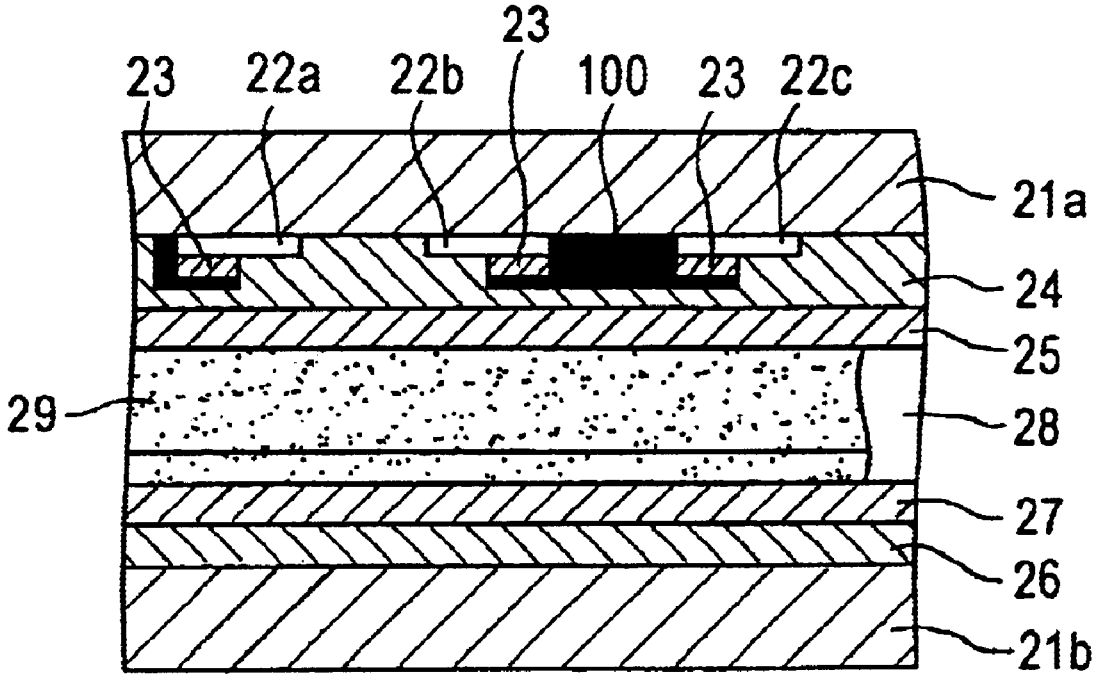

FIG. 10 shows a plasma display panel according to the ninth preferred embodiment of the present invention. According to the present preferred embodiment, a black matrix 100 is formed at the boundary area between neighboring discharge cells and the lower surface of the bus electrode 23.

Since the operation of the plasma display panel having the above structure according to the present invention is the same as that of the conventional plasma display panel, a detailed description thereof will be omitted.

As described above, according to the plasma display panel of the present invention, since the black matrix layer can be simultaneously formed of the same material at the boundary area between the neighboring discharge cells and the lower surfaces of the scanning and common electrodes, a manufacturing process thereof is simplified and thus productivity is improved. Also, optimal contrast can be obtained by forming the black matrix layer in various forms.

What is claimed is:

1. A plasma display panel, comprising:

a front substrate;

a plurality of pairs of sustaining electrodes each pair defining a discharge space of a discharge cell, said pairs of said sustaining electrodes are alternately formed in strips parallel to one another on a lower surface of said front substrate;

a plurality of bus electrodes each formed on a lower surface of one of said sustaining electrodes to have a width narrower than that of the corresponding sustaining electrode;

a first black matrix layer formed on the lower surface of said front substrate, parallel to said sustaining electrodes, and in a boundary area between two adjacent cells among said discharge cells; and a second black matrix layer formed between each of said bus electrodes and the corresponding sustaining electrode;

wherein said first and second black matrix layers are formed of the same material.

2. The plasma display panel as claimed in claim 1, wherein said second black matrix layer is thinner than said first black matrix layer.

3. The plasma display panel as claimed in claim 2, wherein said first and second black matrix layers are integrally formed.

4. The plasma display panel as claimed in claim 1, wherein said second black matrix layer is extended to coat at least one of opposing side surfaces of the corresponding sustaining electrode.

5. The plasma display panel as claimed in claim 2, wherein said first and second black matrix layers are spaced from each other.

6. The plasma display panel as claimed in claim 2, wherein said black matrix layers are formed of a mixture of glass powder, an oxide and a black pigment.

7. The plasma display panel as claimed in claim 1, wherein said second black matrix layer includes conductive particles diffused from the corresponding sustaining electrode so as to provide electrical connection between the corresponding sustaining and bus electrodes.

8. The plasma display panel as claimed in claim 4, wherein said at least one side surface is adjacent to said boundary area.

9. The plasma display panel as claimed in claim 7, wherein said second black matrix layer is thinner than said first black matrix layer.

10. The plasma display panel as claimed in claim 9, wherein said first and second black matrix layers are integrally formed.

11. The plasma display panel as claimed in claim 7, wherein said second black matrix layer is extended to coat at least one of opposing side surfaces of the corresponding sustaining electrode.

12. The plasma display panel as claimed in claim 9, wherein said first and second black matrix layers are spaced from each other.

13. The plasma display panel as claimed in claim 9, wherein said black matrix layers are formed of a mixture of glass powder, an oxide and a black pigment.

14. The plasma display panel as claimed in claim 11, wherein said at least one side surface is adjacent to said boundary area.

15. A plasma display panel, comprising:

a front substrate;

a plurality of pairs of sustaining electrodes each pair defining a discharge space of a discharge cell, said pairs of said sustaining electrodes are alternately formed in strips parallel to one another on a lower surface of said front substrate;

a plurality of bus electrodes each formed on a lower surface of one of said sustaining electrodes to have a width narrower than that of the corresponding sustaining electrode;

a first black matrix layer formed on the lower surface of said front substrate, parallel to said sustaining electrodes, and in a boundary area between two adjacent cells among said discharge cells; and a second black matrix layer formed between each of said bus electrodes and the corresponding sustaining electrode;

wherein said first and second black matrix layers are formed of the same material;

said second black matrix layer is thinner than said first black matrix layer; and said second black matrix layer is not coated in at least a portion of an interface between the corresponding sustaining and bus electrodes allowing the corresponding sustaining and bus electrodes to be electrically connected in a remaining portion of said interface.

16. The plasma display panel as claimed in claim 15, wherein a plurality of through holes are formed in said second black matrix layer so that the corresponding sustaining and bus electrodes are electrically connected via said through holes.

17. The plasma display panel as claimed in claim 15, wherein the corresponding sustaining and bus electrodes are in physical and electrical contact in said remaining portion of said interface.

18. A plasma display panel, comprising:

a front substrate;

a plurality of pairs of sustaining electrodes each pair defining a discharge space of a discharge cell, said pairs of said sustaining electrodes are alternately formed in strips parallel to one another on a lower surface of said front substrate;

a plurality of bus electrodes each formed on a lower surface of one of said sustaining electrodes to have a width narrower than that of the corresponding sustaining electrode; and a black matrix layer formed on the lower surface of said front substrate, parallel to said sustaining electrodes, and in a boundary area between two adjacent cells among said discharge cells, said black matrix layer extending to cover lower surfaces of the bus electrodes associated with the sustaining electrodes of said two adjacent cells which sustaining electrodes are adjacent to said boundary area.

19. The plasma display panel as claimed in claim 18, wherein the corresponding sustaining and bus electrodes are in physical and electrical contact in an entire area of an upper surface of the bus electrode.

20. The plasma display panel as claimed in claim 18, wherein said black matrix layer continuously extends to cover substantially entirely lower surfaces of the associated bus electrodes.

* * * * *